US007345639B2

(12) United States Patent
Prill et al.

(10) Patent No.: US 7,345,639 B2
(45) Date of Patent: Mar. 18, 2008

(54) AUTOMATIC CENTRAL BUFFER COUPLING WITH SIGNAL TRANSMISSION DEVICE

(75) Inventors: Thomas Prill, Gehrden (DE); Reiner Krause, Isernhagen (DE); Karl-Heinz Kraft, Wolfenbuttel (DE)

(73) Assignee: Voith Turbo Scharfenberg GmbH & Co. KG, Salzgitter-Watenstedt (DE)

( * ) Notice: Subject to any disclaimer, the term of this patent is extended or adjusted under 35 U.S.C. 154(b) by 0 days.

(21) Appl. No.: 11/515,665

(22) Filed: Sep. 5, 2006

(65) Prior Publication Data

US 2007/0054562 A1 Mar. 8, 2007

(30) Foreign Application Priority Data

Sep. 8, 2005 (EP) ..... 05019569
Feb. 16, 2006 (EP) ..... 06003184

(51) Int. Cl.
*H01Q 1/32* (2006.01)

(52) U.S. Cl. ..... 343/711; 343/900; 213/1.3; 213/75 R; 439/676

(58) Field of Classification Search ..... 343/711, 343/900, 906; 213/1.3, 75 R, 100; 439/676
See application file for complete search history.

(56) References Cited

U.S. PATENT DOCUMENTS

| | | | | |
|---|---|---|---|---|
| 6,264,048 | B1 * | 7/2001 | Ramnialis et al. | 213/1.3 |
| 6,474,488 | B1 * | 11/2002 | Sullivan | 213/1.3 |
| 2005/0282422 | A1 * | 12/2005 | Jones | 439/320 |
| 2007/0187350 | A1 * | 8/2007 | Kontetzki | 213/75 R |

FOREIGN PATENT DOCUMENTS

| | | |
|---|---|---|
| CH | 676903 | 3/1991 |
| DE | 19934640 | 11/2000 |
| DE | 102004037849 | 7/2005 |

OTHER PUBLICATIONS

Search Report for EP 05019569, Feb. 16, 2006.

* cited by examiner

*Primary Examiner*—Hoang V. Nguyen
(74) *Attorney, Agent, or Firm*—Fulbright & Jaworski L.L.P.

(57) ABSTRACT

The present invention relates to an automatic central buffer coupling for a multi-membered vehicle having a coupling head and a signal transmission device for transmitting signals between a first and a second car body. The invention integrates a signal transmission device into the central buffer coupling. The invention includes a coupling element and a counter-coupling element integrated into respective contact plates of adjacent coupling heads such that the face side of the coupling element is arranged opposite the face side of the counter-coupling element. The coupling element and the counter-coupling element each have an antenna member that includes a disc monopole antenna configured to transmit data in the GHz frequency range.

19 Claims, 6 Drawing Sheets

AUTOMATIC CENTRAL BUFFER COUPLING WITH SIGNAL TRANSMISSION DEVICE

CROSS-REFERENCE TO RELATED APPLICATIONS

The present application claims priority to European Patent Office Application No. EP05019569 filed Sep. 8, 2005, and European Patent Office Application No. EP06003184 filed Feb. 16, 2006.

TECHNICAL FIELD

The present invention relates to an automatic central buffer coupling for a multi-membered vehicle, in particular a rail-borne vehicle.

BACKGROUND OF THE INVENTION

An example of an electric contact coupling for automatic central buffer couplings is known from the EP 0 982 215 B1 printed publication which provides for an electrical cable coupling to be retained in longitudinally-displaceable fashion on a mechanical central buffer coupling. This known cable coupling comprises at least one plug-and-socket connection connected via a connection line arranged on the respective side of a coupling's point of separation for couplable rail vehicles. In order to avoid a redundant contact arrangement disposed symmetrically to the vertical central longitudinal plane of the coupling rod and to be able to configure the cable coupling as a whole in a simpler and lighter manner, the cable coupling according to this prior art furthermore comprises a longitudinally-displaceable adapter box which is arranged between the respective plug-and-socket connections of the rail vehicle in the coupled state and on only one of the respective plug-and-socket connections in the uncoupled state. This adapter box contains the necessary electric connection lines for connecting the connection lines of the rail vehicles to be coupled.

Moreover known from the DE 199 26 085 A1 printed publication, for example, is an electric contact coupling for automatic central or central buffer couplings which has a contact plate comprising contacts for electric connections affixed at the coupling head and displaceable in the longitudinal direction of the central buffer coupling. In order to protect the contact for the electric connections to the greatest extent possible, this prior art also known from the field of rail-borne vehicle technology provides for the contact plate to be displaceable from a rear, uncoupled position into a forward, couple-ready position, wherein the contact plate is covered by a protective cap in the rear position and is uncovered in the forward position by the protective cap being pivoted away.

The fundamental problem with such known systems for transmitting discrete control signals and data signals is the strong mechanical load brought to bear on the electrical contacts used, in particular while coupling. Due to the coupling procedures, which are usually automated, but also due to vibrations and attrition during operation as well as atmospheric effects, conventional signal transmission systems normally used in couplings suffer progressive contact damage. Especially the contact terminals are subject to a considerable degree of wear and corrosion. Among other things, one consequence of this is that the electrical resistance of the electric contacts increases during signal transmission which impairs the quality of the signals to be transmitted and in extreme cases can even lead to the complete loss of the signal connection.

In order to ensure problem-free signal transmission, conventional signal transmission systems therefore require regular maintenance and inspection of the contacts provided in the electric coupling. Required in particular is the regular cleaning and replacement of the electric contact terminals used in the electrical or mechanical coupling.

One possibility of circumventing these problems associated with the conventional transmission of discrete control signals and data signals could, for example, consist of greatly reducing the number of single signal contact terminals used in an electrical contact coupling, which can be done for instance by bundling a plurality of single signal contact terminals or by using a multiplex operation as known per se. While such a solution allows for a lesser total outlay of the wiring necessary for an individual electrical contact coupling such that the electrical contact coupling itself can also be configured smaller if need be, it does not eliminate the fundamental problem of the extreme mechanical load brought to bear on the electrical contacts used as arises during the coupling procedure. Here as well, the electrical contacts are subject to major mechanical load and attrition, especially while being coupled.

Known further from the DE 10 2004 037 849 A1 printed publication is a rail coupling device having a first train coupling and a second train coupling, each connected to the respective car body of a rail-borne vehicle by means of a car attachment. A transmission system which functions without contact for transmitting audio signals, video signals, operational data, commands and/or other bus data is provided between the first rail vehicle and the second rail vehicle. Specifically, the transmission system consists of a first HF component, a second HF component, a first transmitting/receiving device and a second transmitting/receiving device. The HF components are affixed to or in the train coupling, preferably on the side at which the coupling is disposed. The antenna members provided in the signal transmission device as known from the art are each configured as a patch antenna, and in particular as a surface-mountable miniature ceramic antenna.

The disadvantage to this known solution, however, is especially seen as being the low quality to the data transmission. In particular, a patch antenna as the conventional solution suggests is only conditionally suited to non-contact data transmission in an automatic central buffer coupling since the total attenuation of the signal transmission system is relatively high. This makes selecting an accordingly high transmission level for the respective patch antenna imperative. Yet due to the patch antenna's unfavorable radiation pattern, a relatively high transmission level leads to high antenna member interference emissions.

A further disadvantage to the known solution of the prior art is seen in the fact that the patch antennas' immunity to noise; i.e., the irradiation pattern of external background radiation, is also inadequate in the proposed patch antenna configuration. In practical use, such circumstances with this type of signal transmission system can at times only dictate an unreliable and interference-prone data transmission.

Based on the given disadvantages and problems associated with conventional signal transmission systems in couplings, the present invention addresses the task of optimizing an automatic central buffer coupling according to DE 10 2004 037 849 A1 such that data transmission with the signal transmission device functions more reliably and particularly invulnerable to interference, also in particular given low transmitting power with the antenna members utilized.

BRIEF SUMMARY OF THE INVENTION

The present invention relates to an automatic central buffer coupling for a multi-membered vehicle, in particular a rail-borne vehicle, having a first coupling head, with which a frictional connection can be produced in the coupled state between a first and an adjacent second car body with a second coupling head of a counter-coupling, and a signal transmission device for transmitting electric and/or electronic signals between the first and the second car body, wherein the signal transmission device comprises at least one coupling element and at least one counter-coupling element, wherein the coupling element is integrated in a contact plate of the first coupling head and the counter-coupling element is integrated in a contact plate of the second coupling head such that the face side of the coupling element in the contact plane common to the first and second coupling head is arranged opposite the face side of the counter-coupling element, and wherein the coupling element and the counter-coupling element each have at least one antenna member arranged in the respective contact plate of the first and second coupling head such that a clearance results between the two in the coupled state.

Based on the given disadvantages and problems associated with conventional signal transmission systems in couplings, the present invention addresses the task of optimizing an automatic central buffer coupling according to DE 10 2004 037 849 A1 such that data transmission with the signal transmission device functions more reliably and particularly invulnerable to interference, also in particular given low transmitting power with the antenna members utilized.

This task is solved by an automatic central buffer coupling of the type cited at the outset in that each antenna member utilized in the inventive central buffer coupling comprises a disc monopole antenna designed for data transmission in the GHz frequency range.

The solution according to the invention provides a great number of substantial advantages over the central buffer couplings known in the prior art and described above.

Since the coupling element and the counter-coupling element of the signal transmission device are built or integrated into the respective contact plate of the mechanical or electrical coupling head in the solution according to the invention, these elements can be protected particularly well against mechanical damage. As circumstances dictate, the mounting, respectively integration of the coupling element and the counter-coupling element can also be in or on the electric coupling housings generally provided in central buffer couplings. The term "contact plate" as used here refers to those support elements of the electrical or mechanical coupling head which allow the mounting or integration of a coupling element.

By the same token, integrating the coupling element and the counter-coupling element in a contact plate results in a particularly good shielding of the signal transmission device designed for wireless signal transmission. It is hereby possible to avoid irradiating objectionable background radiation in the direct vicinity of the coupling elements as well as external sources of irradiated interference (EMC) in an especially simple and effective manner. The term "wireless signal transmission" as used here refers to any transmission mechanism which does not make use of conventional wired signal data lines as its signal transmission medium; i.e., between the coupling and the counter-coupling element. Included in particular here would be radio transmissions, optical transmissions and other types of transmission based on electromagnetic principles.

Using a signal transmission device designed for wireless signal transmission in a central buffer coupling has the particular advantage of no longer needing a galvanic contact terminal at the coupling interface, i.e. in the common contact plane between the coupling heads of the coupling and the counter-coupling in order to interconnect a plurality of wired signal lines in the coupled state.

Noted as a further advantage to the integration of the coupling element and the counter-coupling element in a contact plane of the respective coupling head in accordance with the invention is that, as need be, the coupling element and the counter-coupling element can also be counter-sunk into the respective contact plate. This is made possible in that the inventive solution makes use of wireless signal transmission such that there is no longer the need (as has previously been the case) for a plurality of mechanically-interconnected galvanic contact terminals in the contact plane of the coupling heads to be coupled together in order to create a wired signal transmission during the coupling procedure. In particular, it is possible to bridge an air gap between the two coupling elements in all spatial axes. A counter-sunk integration of the coupling element and the counter-coupling element in the contact plate of the respective coupling head guarantees the greatest possible protection for the signal transmission device against mechanical damages, in particular while coupling.

Because the solution according to the invention dispenses with the mechanical inter-coupling of galvanic electrical contacts during the coupling procedure, the problem of contact attrition inherent to conventional signal transmission systems is advantageously eliminated.

By the central buffer coupling in accordance with the invention fully dispensing with a signal transmission system based on a galvanic coupling principle and instead using a signal transmission device designed for wireless signal transmission in the central buffer coupling, the further advantage results of not needing to ensure precise centering of the inter-corresponding signal transmission terminals. It was imperative in the prior art to ensure that the respective contact terminals were precisely aligned with one another during the coupling procedure in order to avoid damaging the individual terminals. Whereas with the present invention, it is easy to realize the corresponding design to the coupling element and the counter-coupling element such that unimpaired signal transmission will still be possible even in the case of the respective face sides not overlapping completely in the coupled state. This can be achieved for example by configuring the coupling element and the counter-coupling element such that they transmit/receive the signals to be transmitted at a certain spatial scattering cross section. In other words, this means that in the case of a radio wave signal transmission, as is provided for in the wireless signal transmission according to the present invention, the coupling element as well as the respective counter-coupling element can be configured such that there will be no detriment to the signals to be transmitted even when the face side of the coupling head's coupling element is not arranged exactly opposite the face side of the counter-coupling element integrated in the coupling head of the counter coupling within the contact plane. In conventional solutions, in which signal transmission ensues by means of galvanic coupling of electrical contacts, this would lead to an extremely strong mechanical load on the contacts as employed such that they would be damaged or possibly even destroyed. It is noted here that in the solution according to the invention, the coupling element and the counter-coupling element assume the function of the contact terminals provided in conventional (wired) signal transmission devices.

Because the coupling element as well as the counter-coupling element are arranged close together in the coupled state, in the ideal case adjoining, configuration of the signal transmission device for a near-field signal transmission at an extremely low transmitting power will suffice.

Having the antenna members according to the invention each comprise disc monopole antennas designed for data transmission in the GHz frequency range allows non-contact data transmission to be made between the individual car bodies of a multi-member vehicle, whereby this allows optimum receipt for the associated complementary-configured antenna member even given relatively low transmitting power of the individual disc monopole antennas. Yielded in particular is a transmission between adjacent antenna members of the signal transmission device with extremely low interference. By being configured as disc monopole antennas, the respective antenna members exhibit only negligibly low irradiation into the surroundings. In other words, this means that the solution according to the invention yields minimized total attenuation within the data transmission path. The disc monopole antennas also lend themselves both to single signal transmission (signal bundling via time-multiplex signals) as well as bandwidth signal transmission (data bus, train bus, field bus).

Using disc monopole antennas is especially of advantage in terms of the polar and attenuation pattern necessary for a central buffer coupling. As opposed to other antenna configurations, disc monopole antennas exhibit an optimum radiation pattern especially for use in a signal transmission device for central buffer couplings at a concurrently small size. A signal transmission system can thus be provided with which the disc monopole antennas employed realize an extremely reliable data transmission, in particular not prone to interference, even at low transmitting power.

The solution according to the invention is in particular also distinguished by the fact that the disc monopole antennas employed in the antenna members "inherently" provide excellent directivity for the radiated electromagnetic waves within the central buffer coupling in radio signal transmissions. It has been shown that this specific antenna configuration exhibits a particularly effective radiation pattern in the forward direction. This is achieved in particular by the special configuration as a disc monopole in which the polar pattern of the radiation is optimized. Equivalent results cannot be obtained from conventional antenna systems of comparable dimensions.

The special disc monopole antennas employed in the solution according to the invention exhibit, particularly in the absolute near-field, field strength/power flux density characteristics which allow particularly effective radiation in the forward direction.

Advantageous embodiments of the invention are indicated in the subclaims.

One preferred embodiment of the central buffer coupling in accordance with the invention provides for the respective antenna members of the coupling/counter-coupling element to be configured both for receiving as well as for transmitting signals. In other words, this means that in this embodiment, the respectively active transmitting/receiving area of the coupling element and the counter-coupling element are formed by the respective disc monopole antennas. This thus wards off interference effects during radio transmission without needing to provide special antenna arrangements for spatial diversity or polarization diversity.

In order to realize a configuration to the signal transmission device integrated into the central buffer coupling according to the invention which is especially suppressive of interference, a further preferred embodiment of the central buffer coupling according to the invention provides for the respective antenna members to further comprise a preferably tubular socket coupler member having a cable connection means, in particular an N-type socket, disposed on the end of said socket coupler member facing the car body, wherein the respective disc monopole antenna is accommodated in the associated socket coupler member such that the face side of the disc monopole antenna's radiating/receiving surface is at the contact plane end of said socket coupler member. This is an especially easily realized yet effective solution of configuring the respective antenna members with the disc monopole antennas as integrated into the signal transmission device of the central buffer coupling to be on the one hand rugged and compact, as is necessary when employed in a central buffer coupling. On the other hand, this also allows for a particularly simple mounting or integration of the antenna members in the contact plates of the central buffer coupling's coupling heads. This advantageous embodiment is in particular distinguished by the counter-sunk integration of the antenna member in the contact plate of the coupling head not requiring major effort.

In one possible realization hereto, it would be for example conceivable for the socket coupler member to have a metallic tubular arrangement for the insertion of the respective disc monopole antennas. An intermediate adapter and a connector socket could for example be provided as socket coupler members at the end of the tubular arrangement facing the car body. In particular, the overall dimensions of the socket coupler member with the cable connection means are comparable with those of a coaxial or multi-signal contact suitable for integrating into an automatic central buffer coupling. In other words, this means that the dimensions of the antenna member essentially correspond to those of a conventional coaxial contact for electrical train couplings. This is in fact made possible not leastly due to the actual antenna member being able to be configured extremely compactly based on the excellent radiation pattern of the disc monopole antenna employed.

In order to moreover impede external interference radiation in the antenna members and thus increase the signal transmission device's overall immunity to interference, a particularly preferred embodiment provides for the respective antenna members to further exhibit a shielding tube, whereby the respective disc monopole antenna is accommodated in the associated shielding tube in such a manner that the face-side radiating/receiving areas of the disc monopole antennas do not protrude beyond the contact plate-side terminal region of the shielding tube. Apart from providing the respective antenna members with the most optimum shielding from interference radiation possible from the various sources of interference on the antenna members of the signal transmission device, the shielding tubes further serve—additionally to the special configuration of the disc monopole antennas—to optimize the radiation pattern of the disc monopole antennas in the environment. This thus particularly achieves an optimized polar pattern to the disc monopole antennas in the forward direction. Of course, different solutions with respect to the shielding tubes are also conceivable. For example, it would also be possible for the shielding tubes to be configured as hollow cylindrical bodies of angular cross section.

In a preferred further development of the latter embodiment in which the antenna members further comprise a shielding tube, it is advantageously provided for the shielding tube to exhibit at least one connective element which can engage with at least one correspondingly complementary-configured connective element provided on the respective antenna member. This thus achieves a particularly compact and sturdy configuration to the coupling element, the counter-coupling element respectively.

Another preferred further development of the latter embodiment in which the antenna members further comprise a shielding tube provides for the shielding tube to exhibit a hollow cylindrical body in which a filling substance is at least partially provided such that the respective disc monopole antennas at the contact plane end of the shielding tube facing the lateral face of the coupling element, the counter-coupling element respectively, are covered by this filling substance, wherein the filling substance is as transparent as possible to the GHz frequency range used in the data transmission. Conceivable here would be configuring the shielding tubes as hollow cylindrical sockets which are at least partially filled with the filling substance so as to protect the respective disc monopole antenna of the antenna members on the face side of the coupling or counter-coupling element from atmospheric effects such as, for example, moisture, dirt and/or dust. This filling yields weather resistance to the individual components, and in particular to the signal/transmission device, as necessary especially in the operation of rail vehicles. Selecting a spectral absorption response for the filling substance such that there is an absorption minimum within the GHz frequency range used for the data transmission advantageously ensures that there will be no negative impacting of the transmission-related properties of the signal transmission device, the disc monopole antennas respectively.

In the central buffer coupling according to the invention, the antenna members are advantageously configured in terms of the dimensions of the respective disc monopole antenna, in terms of the clearance between the antenna members in the coupled state, and in terms of the transmitting power available to the respective disc monopole antennas such that the total attenuation occurring during data transmission preferably does not exceed 77 dB. This refers to a maximum allowable attenuation value which is to be observed with respect to the distance between the coupling element and the counter-coupling element as well as with respect to the environmental properties of the signal transmission device in order to enable a reliable and interference-free data transmission, even given low transmitting power with the antenna members employed. In the process, a sufficient attenuation reserve is already provided to compensate for slight changes in the air gap between the coupling element and the counter-coupling element and to compensate for radiating surface impurities with the antenna members integrated into the coupling element and the counter-coupling element so as to be able to ensue reliable signal transmission even given such circumstances.

One preferred embodiment further provides for configuring the coupling element and the counter-coupling element such that there is a complete outward encapsulation of the coupling element and the counter-coupling element in the coupled state. This type of complete encapsulation advantageously allows an additional shielding of the active elements of the signal transmission device, i.e. the coupling element and the counter-coupling element, and that as regards interference emissions and radiation (EMC). Conceivable in this regard could be, for example, providing the corresponding additional shielding or sealing means on the respective face side of the coupling element and the counter-coupling element in order to ensure the complete encapsulation of the coupling elements in the coupled state of the central buffer coupling.

A particularly preferred realization of the solution according to the invention provides for the coupling element and the counter-coupling element to each comprise at least one antenna member. The face side of the antenna member integrated into the coupling head of the coupling is advantageously arranged in the contact plane of the coupling head opposite the face side of the antenna member integrated into the coupling head of the counter-coupling. Although it would also be conceivable to arrange the respective antenna members in the contact plates of the respective coupling heads such that there would be a certain clearance between the face sides of the antenna members in the coupled state. This likewise preferred embodiment to the face sides of the respective antenna members; i.e. the actively radiating areas of the coupling element and the counter-coupling element being distanced from one another and thus positioned opposite one another without being in contact, achieves a particularly more effective and thereby easily realized protection for the signal transmission device against the mechanical damage which can occur from jolts or impacts, in particular during the coupling procedure. It is of course also conceivable to arrange the respectively active radiating areas of the coupling element and the counter-coupling element without any clearance (air gap) in the coupled state.

It is particularly preferred for the coupling element and the counter-coupling element to have at least one antenna member and for the antenna member to thereby be hermetically sealed in said coupling element and counter-coupling element. Such a hermetic encapsulating of the antenna member ensures that any potential environmental effects such as, for example, moisture, dew formation or impurities will only have a negligible effect on the field strengths impacting the respective antenna member. It is thus possible to produce a particularly robustly-configured signal transmission device which is resistant to both mechanical influences as well as contamination, etc.

A particularly preferred realization of the central buffer coupling according to the invention provides for the signal transmission device used in the central buffer coupling to further comprise an electronic unit assigned to the coupling element and an electronic unit assigned to the counter-coupling element for controlling the signal transmission. The electronic unit of the coupling element is thereby connected to the antenna member assigned to the coupling element and the electronic unit of the counter-coupling element to the antenna member assigned to the counter-coupling element. The spatial separation provided by means of these electronic units fulfilling the signal transmission device's transmitting/receiving function for the electronics and antenna assemblies necessary for controlling the signal transmission enables a particularly simple and thereby effective way of individually adapting the signal transmission device to specific applications. The signal transmission device can in particular be modified by substituting the respective electronic units without needing to replace the transmitting/receiving elements in the contact plate of the respective coupling head. This advantageous further development to the signal transmission device used in the central buffer coupling according to the invention thus increases the flexibility with which the signal transmission device can be used in the automatic central buffer coupling which in turn results in lower maintenance costs. For example, it is conceivable for the electronic units to be arranged spatially separated from the associated coupling elements, for example at a distance from the coupling head in the respectively associated car body, in order to position the electronics providing the signal transmission in the most protected manner possible.

A particularly preferred realization of the latter cited preferred embodiment of the central buffer coupling according to the invention with integrated signal transmission device provides for each electronic unit to have at least one RF unit, one modulator/demodulator unit, one baseband processor, one medium access control and/or one application processor. This has the advantage that all the electronics required for signal transmission are contained within the respective electronic unit. The RF unit, which works in an advantageous embodiment in the 2.4 GHz range according to the WLAN IEEE 802.11b standard can, for example, be responsible for generating the high-frequency energy (carrier energy) for the receiver and for the transmitting/receiving points. Of course other standards are likewise conceivable here including higher frequency for realizing larger gross data rates. Relevant to modulating/demodulating the information-carrying signals (baseband) on the carrier is arranging the modulator/demodulator unit upstream or downstream the RF unit. This functional assembly can be implemented as a component of a baseband processor which can also assume other functions such as the coding and/or decoding of the information to be transmitted as well as the control of the medium access. The baseband processor furthermore assumes and/or provides the reference data. Optionally provided application processor on the hardware side can constitute the interface between the signals/data to actually be transmitted and the transmitting medium. The application processor thereby also advantageously assumes a gateway/bridge function. The optionally appropriate hardware extensions can be provided in the signal transmission device of the central buffer coupling according to the invention for coupling with standardized bus systems such as, for example, CAN, MVB/WTB, FIP or LON, as well as with discrete control signals. It is, however, not imperative for each electronic unit to be provided with the cited components.

In a particularly preferred further development of the latter cited embodiment, at least one of the respective electronic units has at least one additional data interface, in particular a central serial bus interface for connecting additional hardware. This makes it possible to couple hardware extensions to the electronic unit for data incurred at a bit rate of <1 Mbit/s. Applications with higher bandwidth needs can be optionally coupled directly via serial high-speed interfaces or directly via parallel bus interfaces which can likewise be provided in the respective electronic units. Of course, other embodiments of the respective electronic units are just as conceivable here as well.

In an advantageous further development of an automatic central buffer coupling comprising the signal transmission device with the coupling element, the counter-coupling element, the respective antenna members and the respective electronic units, although already known to some degree in electronics, both the coupling element and the counter-coupling element have at least one cable connection area. This cable connection area can be (although not mandatory) connected to the respective antenna member by means of an adapter piece; under certain circumstances, an adapter piece is also not imperative. On the other hand, the cable connection area is furthermore advantageously connected to the respective electronic unit by means of a cable connection, in particular a coaxial feeder line. This cable connection should advantageously be of high quality, which thus likewise eliminates emission/radiation effects behind the coupling or counter-coupling element. This technical realization moreover achieves a strong and secure "attachment" for the connection (the coaxial cable). This preferred embodiment thus provides a particularly effective and reliable signal transmission device. It is in particular conceivable for the respective disc monopole antennas of the antenna members to have the lowest attenuating coaxial cable as possible, preferably RG 213, which exhibits an N-type plug, an N-type socket respectively, to connect the respective electronic units.

Finally, in order to realize a signal transmission device integrated into the central buffer coupling according to the invention which is of a particularly compact configuration and one protected from mechanical damage, it is provided for the coupling element and the counter-coupling element to each be provided with an antenna member and a cable connection area, whereby the coupling element and the counter-coupling element are each realized as a casing in the contact plate of the associated coupling head which accommodates at least the associated antenna member and the associated cable connection area. It is, of course, also conceivable to integrate further components of the signal transmitting device in such a casing.

A particularly preferred realization of the central buffer coupling according to the invention provides for using a WLAN signal transmission system as the signal transmitting device. Providing this type of WLAN transmission path between the coupling element and the counter-coupling element of the signal transmitting device allows a data connection at a gross bandwidth of up to 11 Mbit/s to be realized at minimum fluctuation in receiving field strength due to the near-field coupling. Of course, other standards in order to achieve higher gross bandwidths are also conceivable. The desired near-field coupling at the same time solves the main problem of utilizing WLAN, that being the dependency of a given bandwidth on the distance between communication partners. For this reason, using a WLAN signal transmitting device in the inventive solution is of advantage.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
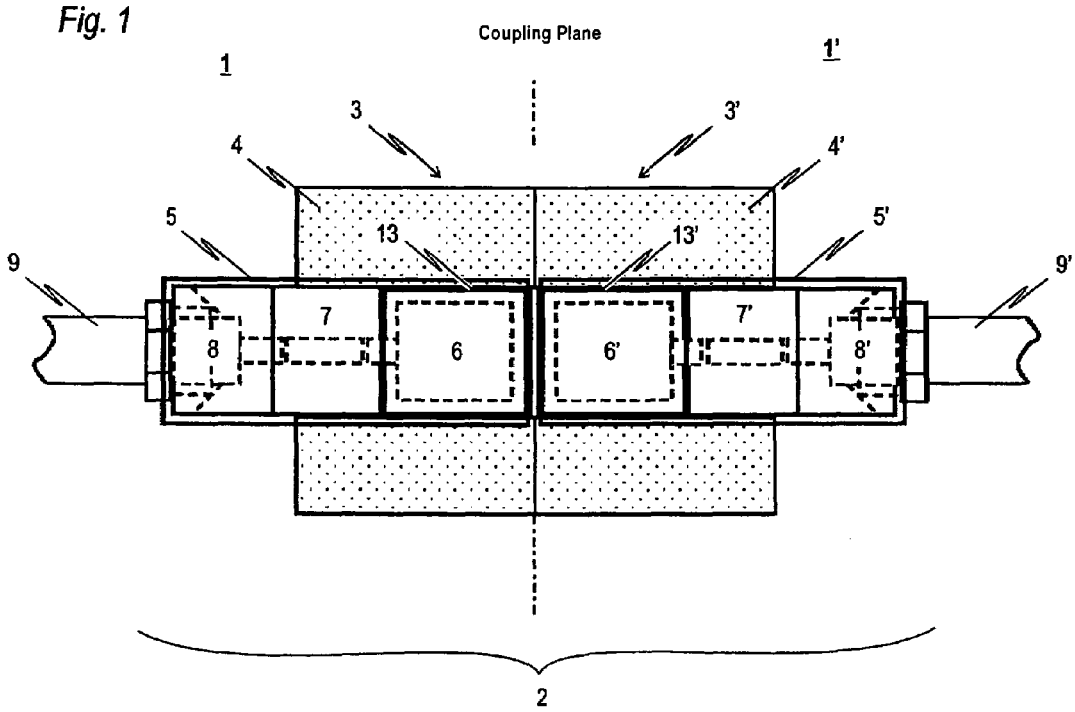
FIG. 1 is a schematic representation of a signal transmission device integrated into the inventive central buffer coupling in a preferred embodiment.

FIG. 1 is a schematic representation of one possible embodiment of the central buffer coupling 1 according to the invention which integrates a signal transmission device 2. Specifically, FIG. 1 shows a cutaway view of the signal transmission device 2 integrated in a coupled central buffer coupling 1.

The central buffer coupling 1 depicted in FIG. 1 consists of a (not explicitly shown) coupling head 3 which is coupled in the depicted state with the (likewise not explicitly shown) coupling head 3' of a counter-coupling 1'. Both coupling heads 3, 3' have a contact plate 4, 4', their respective faces abutting in the coupling plane in the coupled state. The signal transmission device 2 is integrated into contact plate 4 of coupling head 3 of coupling 1 and into contact plate 4' of coupling head 3' of counter-coupling 1'.

The signal transmission device 2 exhibits a coupling element 5 and a counter-coupling element 5', whereby the coupling element 5 is integrated into contact plate 4 of coupling head 3 of the coupling 1 and the counter-coupling element 5' in contact plate 4' of coupling head 3' of the counter-coupling 1'. It is thereby provided for the face side of coupling element 5 to be arranged in the contact plane of coupling head 3 opposite the face side of the counter-coupling element 5' integrated into coupling head 3' of counter-coupling 1'.

The coupling elements 5, 5' to be integrated in the electrical coupling or alternatively in the mechanical coupling, each consist conceptionally of a tube arrangement (metal) having an integrated antenna member 6, 6', an adapter piece 7, 7' and a cable connection area 8, 8'. The antenna member 6, 6' can likewise have an additional adaptive network. As depicted, the overall dimension to coupling element 5, counter-coupling element 5' respectively, is comparable to a conventional coaxial contact suitable for incorporation into, for example, a rail vehicle coupling.

In the coupled state, the coupling element 5 and the counter-coupling element 5' are completely encapsulated which yields protection against radiant leakage in the coupled state. Accordingly, an additional shielding effect is achieved with respect to interference irradiation/radiation (EMC).

Antenna members 6, 6' integrated into coupling element 5 and counter-coupling element 5' having the active radiating areas for the wireless signal transmission are positioned opposite one another in the depicted embodiment without being in contact and hermetically sealed so as to avoid damage during the coupling procedure as well as to protect against impact. There is a correspondent air gap between the respective face sides of contact plates 4, 4' and the respective antenna members 6, 6'. Any potential effect which may arise such as, for instance, condensation of moisture, formation of dew or contamination will thereby only have a negligible effect on the respective field strength impacting antenna member 6, 6'.

The cable connection area 8, 8' of coupling element 5, counter-coupling element 5' respectively, is preferably of high quality. This likewise serves to avoid the effects of irradiation/radiation behind the respective coupling element 5, 5' and additionally enables a more secure and strong "attachment" of the cable. The cable is preferably a coaxial cable, although other wired connections are, of course, also just as conceivable.

Figure 2:
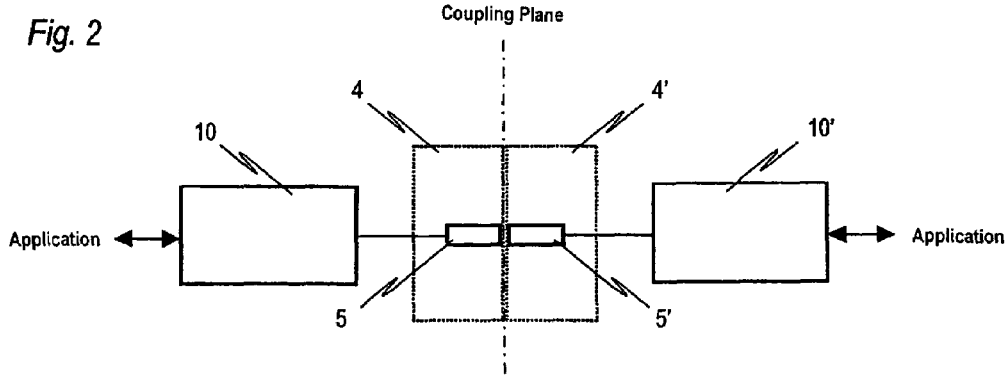
FIG. 2 is a schematic representation of the WLAN transmission path in the signal transmission device of FIG. 1.

FIG. 2 is a schematic representation of the signal transmission path configured between coupling element 5 and counter-coupling element 5'. Establishing a complete transmission path requires both coupling elements 5, 5', two coaxial feeder lines 9, 9' and two electronic units 10, 10'. The preferred embodiment of signal transmission device 2 utilizes near-field WLAN signal transmission. Using an IEEE 802.11b WLAN assembly can realize data connections having a gross bandwidth of up to 11 Mbit/s at minimum fluctuation in receiving field strength due to the near-field coupling.

The signal transmission device 2 integrated into the central buffer coupling 1 in accordance with the invention can of course also be designed for standards which will be further developed in the future. These further standards to be developed correspond to signal transmission devices having clearly higher bandwidths (up to 100 Mbit/s). The present application preferably utilizes a point-to-point conception based on an adhoc network for radio coupling. This configuration is to date uncommon in WLAN applications and is termed IBSS (independent basic service set) in the IEEE 802 standardization environment.

High-quality cables 9, 9' are preferably used to connect the antenna members 6, 6' in coupling element 5 and/or counter-coupling element 5' to the respective electronic units 10, 10' which despite the high operating frequencies, yield low performance losses on the one hand and excellent shielding properties on the other. Such cables are already established within the field of application of central buffer couplings and are commercially available. In practical realization, lead lengths of between 8 and 10 meters per antenna member 6, 6' would be required.

With the solution according to the invention, it is further preferable to be able to completely switch off the irradiating of coupling element 5, 5' (i.e., the WLAN transceiver incorporated therein) in decoupled state utilizing an accordingly secure and reliably designed mechanism. Suited hereto, for example, would be a status signal already provided in the field of coupling control such as e.g. "mechanically coupled" or "electrically coupled."

Figure 3:
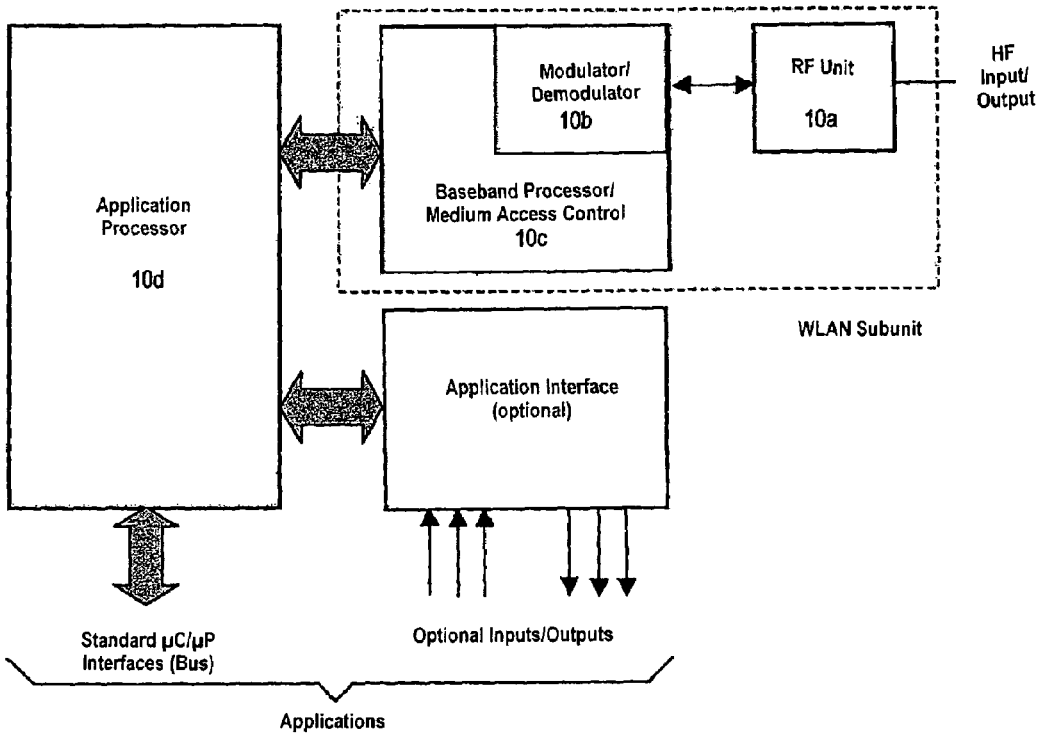
FIG. 3 is a schematic representation of an electronic WLAN unit as used in the signal transmission device according to FIG. 1.

FIG. 3 is a schematic representation showing the signal transmission device 2 used in the central buffer coupling 1 according to the present invention. An electronic unit 10 is provided to operate the WLAN signal transmission which can consist of an RF unit 10*a*, a modulator/demodulator unit 10*b*, a baseband processor 10*c* or a medium access controller, as well as at least one application processor 10*d*. The RF unit 10*a* can be configured as a high-frequency transceiver which assumes the function of a transmitter/receiver.

The RF unit 10*a* is hereby responsible for generating the high frequency energy (of the carrier) for the receiver and for the transmitting/receiving points and preferably works in the 2.4 GHz band pursuant the WLAN IEEE 802.11b standard. It is however also conceivable that a further development of the standard will use higher frequencies to realize larger gross data bandwidths.

The RF unit 10*a* is arranged upstream or downstream a modulator/demodulator unit 10*b* for modulating/demodulating the information-carrying signals on the baseband. These functional assemblies are a component of the baseband processor 10*c* which, among other things, also assumes the coding/decoding of the information to be transmitted and the control of the medium access. The baseband processor 10*c* assumes and/or provides the reference data.

On the hardware side, the application processor 10*d* forms the interface between the signals to actually be transmitted and the WLAN transmission medium. The application processor 10*d* thereby advantageously assumes a gateway/bridge function. Optionally appropriate hardware extensions can be provided in the form of so-called physical layers to couple with standardized bus systems such as, for example, CAN, MVB/WTB, FIP or LON, as well as discrete control signals. Simple serial data interfaces such as RS-232 or SPI, for instance, are already advantageously integrated in the microprocessor.

In principle, additional hardware extensions can be coupled to electronic unit 10 through a central standardized bus interface such as e.g. CAN. Applications requiring a higher broadband, i.e. a need greater than approximately 1 MBit/s, should be directly coupled through a serial high-speed interface such as e.g. SPI or USB, or directly through the parallel μC/μP bus.

The WLAN technology used in the signal transmission pursuant the IEEE 802.11b provides a gross data rate in the best case of 11 Mbit/s and can function with relatively small antenna members 6, 6'. The antennas usually amount to an integral multiple of λ/4. As hardware, economical variants for the WLAN connection are also commercially available in modular size.

Among other things, spread-spectrum technology reduces the effect of narrow-band and broad-band disturbances. WLAN transmission technology uses a total of 79 channels in the 2.4 GHz band to transmit between transmitters and receivers. The DSSS process bundles 13 (in Europe) and 11 (in the USA) channels. Multiplication with a pseudo noise code spreads the signals to be transmitted to the necessary bandwidth. This pseudo noise code is stipulated between transmitter and receiver prior to the transmission. The receiver recovers the original signal by remultiplication (despreading) and filtering (low-pass). These properties inherent to WLAN transmission technology are, of course, also provided in the central buffer coupling 1 according to the invention.

Due to e.g. the low transmitting level compared to GSM and the spread spectrum used, utilizing WLAN transmission technology generates a relatively low disturbance field strength in the direct zone vicinity which can be reduced to a virtually negligible value by the appropriate incorporation and shielding. By means of the coupling used in the present invention in the near-field, after the corresponding selection and adaptation of an antenna member 6, 6' with sufficient field strength reserve, a high average data transmission rate can be obtained compared to the far field (standard application).

The LCC (Logical Link Control) provided in the lower protocol layer (layer 2, data link layer pursuant ISO/OSI) secures the existing data link. Added transmission reliability can be achieved with suitable protocols such as e.g. TCP.

Figure 4A:
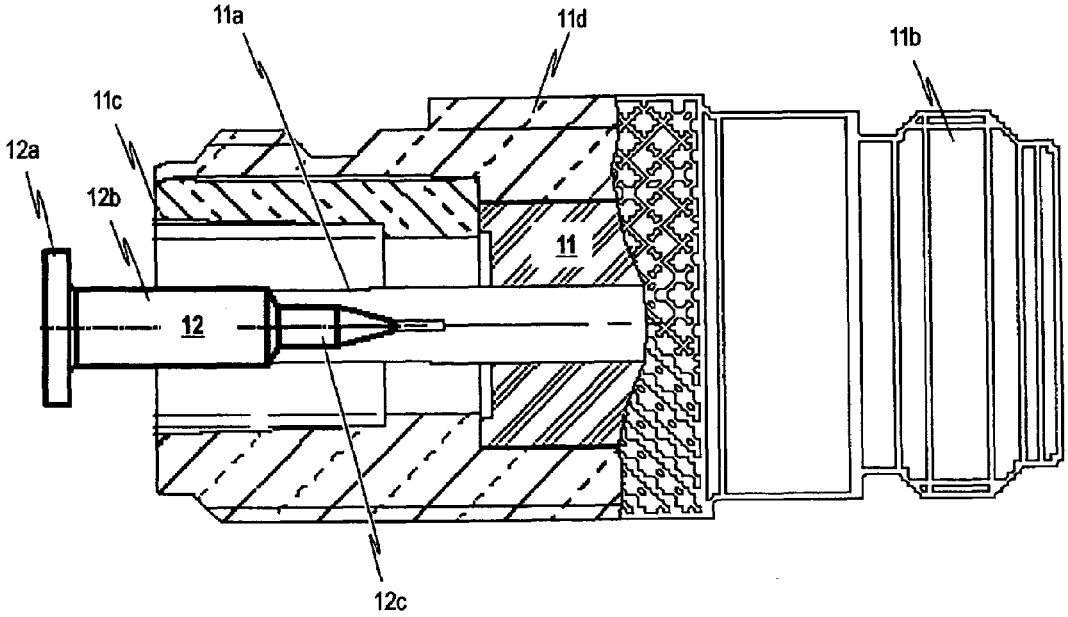
FIGS. 4*a* and 4*b* are side cutaways or perspective views of the special disc monopole antenna as used in the antenna members of the signal transmission device according to FIG. 1.
Figure 4B:
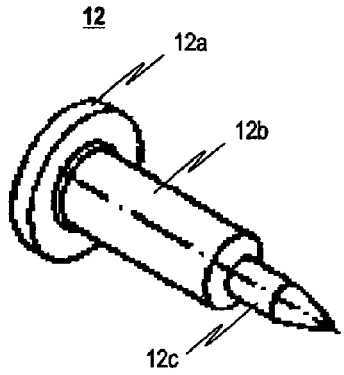
Figure 5A:
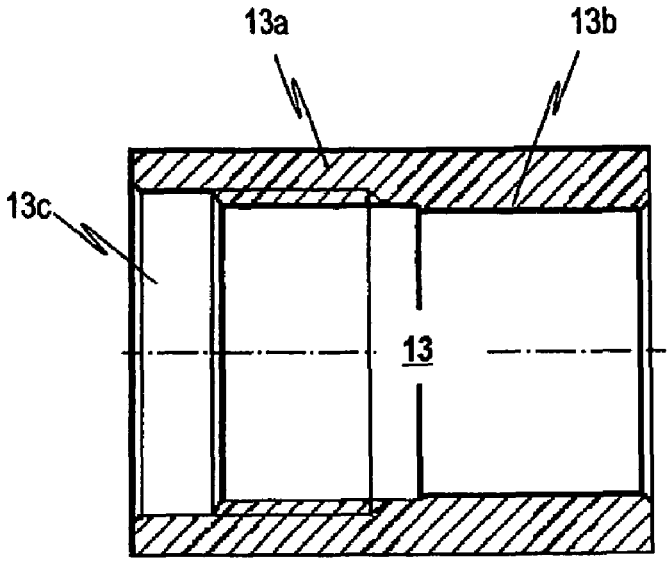
FIGS. 5*a* and 5*b* are side cutaways or perspective views of a shielding tube as used in the antenna members of the signal transmission device according to FIG. 1.
Figure 5B:
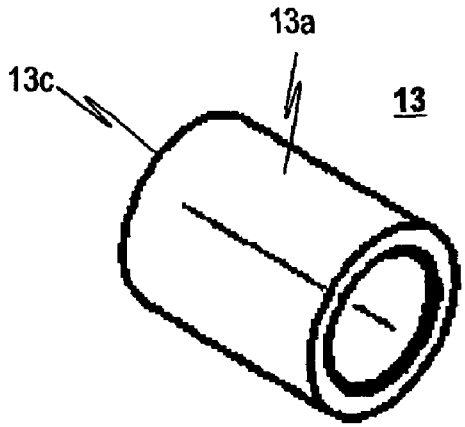
Figure 6:
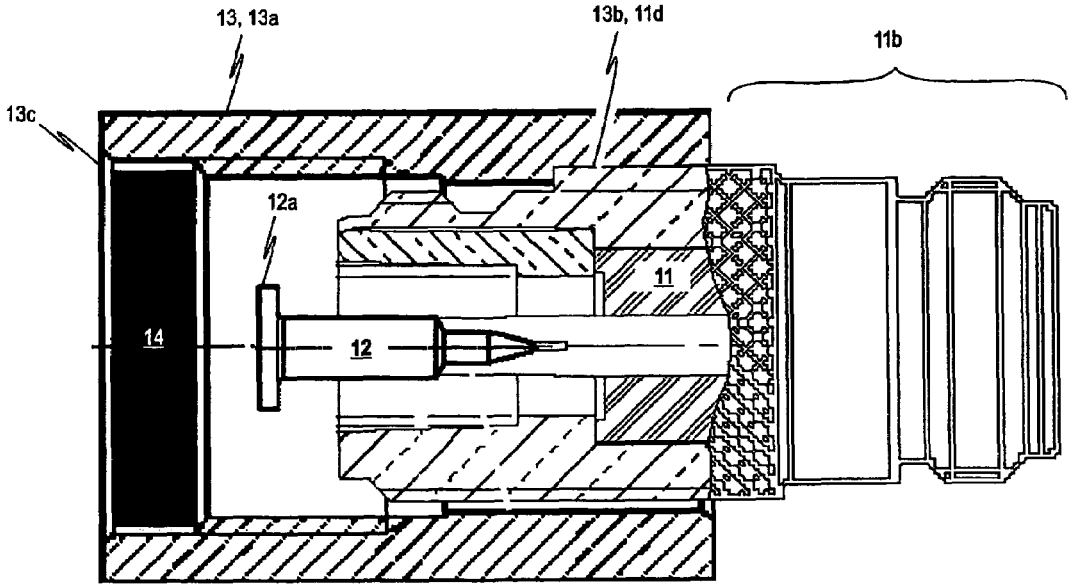
FIG. 6 is a side cutaway view of the antenna members of the signal transmission device according to FIG. 1 consisting of the special disc monopole antenna in accordance with FIG. 4*a* and the shielding tube of FIG. 5*a;*

FIGS. 4*a, b* show a partially cutaway side or perspective view of the special disc monopole antenna 12 used in the antenna members 6, 6' of the signal transmission device 2 according to FIG. 1. FIGS. 5*a, b* show a cutaway side or perspective view of a shielding tube 13 used in the antenna members 6, 6' of the signal transmission device 2 according to FIG. 1. FIG. 6 is a cutaway side view of an antenna member 6, 6' of the signal transmission device 2 according to FIG. 1, consisting of the special disc monopole antenna 12 according to FIG. 4*a* and the shielding tube 13 of FIG. 5*a*.

FIG. 4*a* further shows—in addition to the disc monopole antenna 12—a socket coupler member 11 (in partially cutaway representation) which is utilized as an adapter piece 7, 7' in the respective antenna members 6, 6' of the signal transmission device 2 depicted in FIG. 1.

As depicted, the disc monopole antenna 12 consists of a plate-shaped emitting/receiving area 12*a*, which constitutes the active emitting/receiving element of the disc monopole antenna 12, the antenna members 6, 6' respectively. The emitting/receiving area 12*a* is retained by an antenna shaft 12*b* which extends along the symmetrical axis of the disc-shaped emitting/receiving area 12*a*. The antenna shaft 12*b* gives way at its end facing the car body into an antenna connection area 12*c*. This antenna connection area 12*c* is connected to the corresponding coaxial connection line 9, 9' in the signal transmission device 2 via cable connection area 8, 8' shown in FIG. 1 and as necessary the adapter piece 7, 7' (respectively by means of the socket coupler member 11 serving as an adapter piece).

The socket coupler member 11 shown in FIG. 4*a* in a schematic partially cutaway representation, which corresponds in function to the adapter piece 7, 7' in FIG. 1, is for example an N-type socket and exhibits a tubular body 11*a* as well as car body-end terminal region 11*b* configured as cable connection means. The disc monopole antenna 12 is accommodated in the socket coupler member 11 such that the face-side emitting and receiving area 12*a* of said disc monopole antenna 12 is positioned in the terminal region 11*c* of socket coupler member 11 on the contact plane side. Specifically, the active region, i.e. the emitting/receiving area 12*a* of monopole antenna 12 extends beyond the terminal region 11*c* of socket coupler member 11 on the contact plane side.

The disc monopole antenna 12 is inserted in socket coupler member 11, and in particular in tubular body 11*a* of socket coupler member 11, whereby there is preferably a frictional connection between the antenna shaft 12*b* of the disc monopole antenna 12 and the tubular body 11*a* of the socket coupler member 11.

The arrangement shown in FIG. 4*a*, consisting of the disc monopole antenna 12 and the socket coupler member 11, is of an overall size which roughly equals that of a conventional coaxial contact terminal. The socket coupler member 11 thereby supports the disc monopole antenna 12, whereby a socket coupler compatible with a conventional contact terminal is advantageously configured on the terminal region 11*c* of the socket coupler member 11 at the car body end such that the disc monopole antenna arrangement shown in FIG. 4*a* can be connected to a coaxial contact terminal in a simple manner. The socket coupler is advantageously of high quality in order to, on the one hand, avoid effects of irradiation/radiation behind disc monopole antenna 12 and, on the other, enable a secure and rugged "attachment" for a suitable coaxial or signal cable.

FIG. 5*a* shows the shielding tube 13 used in the signal transmission device 2 according to FIG. 1 for reducing interference emissions and increasing the noise immunity for antenna members 6, 6', disc monopole antenna 12 respectively. In essence, shielding tube 13 consists of a tubular shielding body 13*a* and a connective element 13*b* preferably integrally configured in body 13*a*.

In the assembled state of the antenna member 6, 6' shown in FIG. 6, the disc monopole antenna arrangement shown in FIG. 4*a*, consisting of the disc monopole antenna 12 as well as the socket coupler member 11 serving as adapter piece 7, 7', is surrounded by the shielding tube 13 such that the face side emitting and receiving area 12*a* of the disc monopole antenna 12 does not extend beyond the terminal region 13*c* of the shielding tube 13 on the contact plane side.

Specifically, FIG. 6 shows an antenna member 6, 6' used in the preferred embodiment according to FIG. 1 of the central buffer coupling 1, 1' according to the invention, wherein the antenna member 6, 6' comprises the disc monopole antenna 12 shown in FIG. 4*a*, the socket coupler member 11 likewise shown in FIG. 4*a* (here assuming the function and tasks of the adapter piece 7, 7' shown in FIG. 1) and the shielding tube 13 shown in FIG. 5*a*.

As depicted, the disc monopole antenna 12 is accommodated within shielding tube 13 such that the face-side emitting and receiving area 12*a* of the disc monopole antenna 12 does not extend beyond the terminal region 13*c* of shielding tube 13 on the contact plane side. The shielding tube 13 itself engages with a correspondingly complementarily configured connective element 11*d* provided on socket coupler member 11 via connective element 13*b* so that the arrangement shown in FIG. 6 is extremely robust and stable. This arrangement moreover achieves the full outward shielding and encapsulating of the disc monopole antenna 12 up to the face side surface of the terminal region 13*c* of shielding tube 13 on the contact plane side.

In the area directly in front of the face side emitting and receiving area 12*a* of the disc monopole antenna 12, a filling substance 14 is furthermore filled into the shielding tube 13 such that the filling substance 14 covers the disc monopole antenna 12 on the contact plane side end 13*c* of shielding tube 13 toward the face side of the (not explicitly shown) coupling element, counter-coupling element 5, 5' respectively. The filling substance 14 primarily serves to protect the active area 12*a*, the entire disc monopole antenna 12 respectively, against atmospheric influences, especially dust and moisture.

In order to ensure that data transmission utilizing the disc monopole antenna 12 is not affected negatively, the filling substance 14 is configured so as to be as transparent as possible to the Gigahertz frequency range used for the data transmission. The disc monopole 12*a* of the disc monopole antenna 12 is furthermore arranged in coupling element 7, 7' radial to the effective direction, whereby in addition to a good shielding effect to the environment, the shielding tube 13 also ensures excellent directivity to the electromagnetic waves emitted.

The filling substance 14 injected into the space between the terminal region 13*c* of shielding tube 13 and the disc monopole 12*a* to protect antenna member 6, 6', the disc monopole antenna 12 respectively, is preferably a polyurethane of low dielectric permeability. This thereby results in a flat active surface to antenna coupler 7, 7'.

Figure 7:
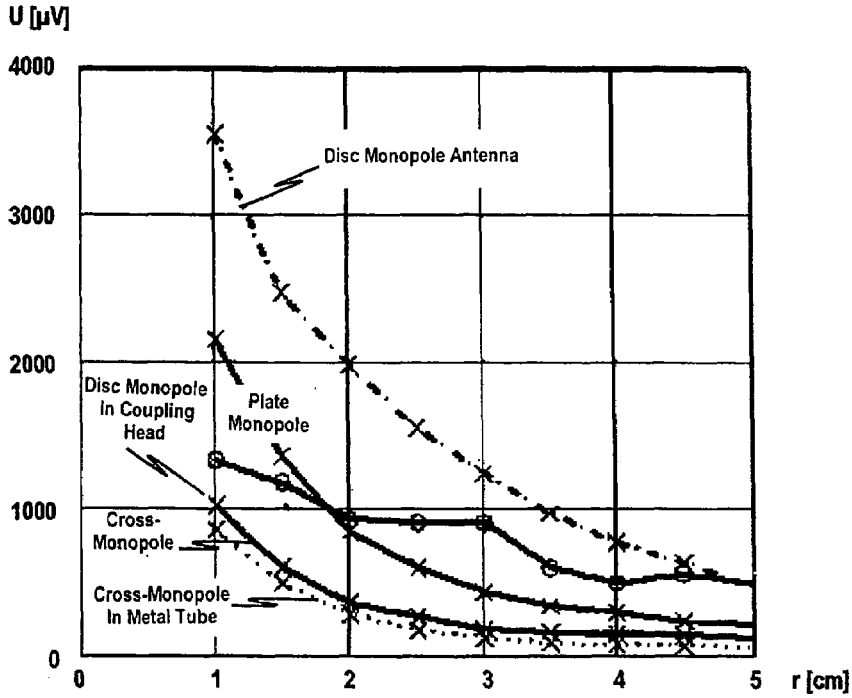
FIG. 7 is a graphic plotting of the electrical receiving voltage attainable with the special antenna configuration in accordance with FIG. 6 based on the distance between the respective antenna pair in the signal transmission device according to FIG. 1 compared to other antenna configurations.
Figure 8:
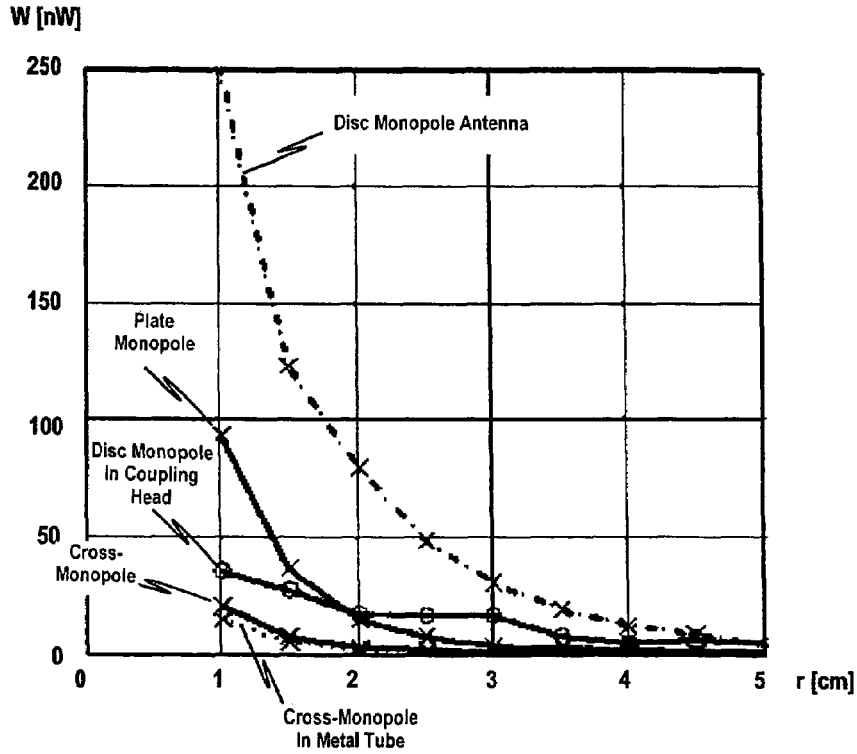
FIG. 8 is a graphic plotting of the receiving power attainable with the special antenna configuration according to FIG. 6 based on the distance between the respective antenna pair in the signal transmission device according to FIG. 1 compared to other antenna configurations.

FIG. 7 is a graphic plotting of the electrical receiving voltage attainable with the special antenna configuration according to FIG. 6 in dependence on the distance between the respective antenna pair 6, 6' in the signal transmission device 2 according to FIG. 1 compared to other antenna configurations, while FIG. 8 is a graphic plotting of the receiving power attainable with the special antenna configuration according to FIG. 6 depending on the distance between the respective antenna pair 6, 6' in the signal transmission device 2 according to FIG. 1, and specifically in comparison to other antenna configurations.

In detail, FIG. 7 shows the electrical receiving voltage during transmission (in μV) between different pairs of antennas depending on distance (r) in centimeters, and specifically for a cross-monopole antenna, a cross-monopole antenna in a shielding tube, a monopole antenna having a plate, a monopole antenna having a disc and for a monopole antenna having a disc in the coupling head. As depicted, the electrical receiving voltage of the special disc monopole antenna 12 as utilized in the solution according to the invention is clearly higher than the receiving voltage of the other antenna configurations.

FIG. 8 depicts the receiving power (in nW) during transmission between the checked pairs of antennas in FIG. 7 as a function of distance (r). Here as well, the receiving power with the disc monopole antenna 12 according to the invention is clearly higher than is the case with comparable conventional monopole antennas.

In brief, the inventive solution yields the following properties and advantages:

a) The signal transmission device 2 utilized in the central buffer coupling 1 according to the invention advantageously uses a frequency band with sufficient transmission channel bandwidth to transmit digital signals in the range of (initially) 1 to 10 Mbit/s.

b) According to the invention, a transmission standard is utilized for the signal transmission with distinct properties as far as transmission quality, interference suppression and fault tolerance.

c) The inventive solution enables wireless near-field signal transmission at low transmitting power.

d) The inventive solution utilizes robust and compact coupling elements 5, 5' for integration into the mechanical coupling head 3, 3', the existing electrical coupling housing respectively. In so doing, the active elements of coupling elements 5, 5' are thus preferably of counter-sunk integration for the greatest possible protection against damage. This hereby also fulfills the requirements for good shielding effect to avoid undue interference radiation in the direct vicinity and irradiation from external sources of interference (EMC).

e) Using a wireless signal transmission device 2 guarantees a tolerance with respect to axial, horizontal and vertical coupling play of up to 5 mm in each direction; i.e., a three-dimensional degree of flexibility to the signal transmission.

f) Identical coupling elements 5, 5' are used in the signal transmission device 2 for both coupling components 1, 1' (coupling 1 and counter-coupling 1') in order to minimize system costs and increase the degree of flexibility for system integration.

g) Electronic units 10, 10' having interfaces for standardized serial data sources (bus systems) or discrete signals (multiplex switchboxes) are provided, in particular for integration in the front sections of vehicles (if need be in a system cabinet). The connection of the coupling elements 5, 5' with electronic units 10, 10' thereby ensues with the appropriate cable connections 9, 9', in particular an HF coaxial cable.

h) Activating and/or deactivating signal transmission device 2 is preferably enabled via the "electrically/mechanically coupled" signal as normally incorporated in automatic central buffer couplings.

i) Apart from normal system care (software as the need may be), the solution according to the invention provides for completely maintenance-free operation.

It is noted at this point that the central buffer coupling 1 according to the invention is not limited to couplings as used in rail-mounted vehicle technology. In fact, the solution according to the invention is applicable to all multi-member vehicles.

What is claimed is:

1. An automatic central buffer coupling for a multi-membered vehicle comprising:

a first coupling head of a first car body, said first coupling head comprising a coupling element and a first contact plate;

a second coupling head of a second car body, said second coupling head comprising a counter-coupling element and a second contact plate;

a signal transmission device configured to transmit electric and/or electronic signals between the first car body and the second car body, said signal transmission device comprises said coupling element and said counter-coupling element;

wherein said first coupling head and said second coupling head are configured such that a frictional connection can be produced in the coupled state between said first coupling head and said second coupling head and said coupling element is integrated in said first contact plate and said counter-coupling element is integrated in said second contact plate such that a face side of said coupling element is arranged in a contact plane common to said first coupling head and said second coupling head opposite a face side of said counter-coupling element;

wherein said coupling element comprises at least one antenna member arranged in said first contact plate;

wherein said counter-coupling element comprises at least one antenna member arranged in said second contact plate, said at least one antenna member of said coupling element and said at least one antenna member of said counter-coupling element configured such that a clearance results between said at least one antenna member of said coupling element and said at least one antenna member of said counter-coupling element when said first coupling head and said second coupling head are in the coupled state; and wherein each of said at least one antenna members comprises a disc monopole antenna configured to transmit data in the GHz frequency range.

2. The automatic central buffer coupling of claim 1 wherein each of said at least one antenna members is configured to both receive as well as transmit signals.

3. The automatic central buffer coupling of claim 1 wherein each of said at least one antenna members further comprises:

a tubular socket coupler member having a cable connection means disposed on a car body-side terminal region of said socket coupler member; and wherein said disc monopole antenna of each of said at least one antenna members is accommodated in the associated tubular socket coupler member such that a face side of a radiating and receiving area of said disc monopole antenna is in a contact plane-side terminal region of said associated tubular socket coupler member.

4. The automatic central buffer coupling of claim 1 wherein said each of said cable connection means comprises:

an N-type socket.

5. The automatic central buffer coupling of claim 1 wherein:

each of said at least one antenna members comprises a shielding tube having a terminal region for reducing interference emission and increasing the immunity to interference; and wherein said disc monopole antenna of each of said at least one antenna members is accommodated in said shielding tube in such a manner that a face-side radiating/receiving area of said disc monopole antennas does not protrude beyond a terminal region of said shielding tube on a contact plate side.

6. The automatic central buffer coupling of claim 5, wherein each of said shielding tubes comprises:

a connective element capable of engaging with a correspondingly complementary-configured connective element provided on each said at least one antenna members.

7. The automatic central buffer coupling of claim 5 wherein each of said shielding tubes comprises:

a hollow cylindrical body; and a filling substance at least partially filling said hollow cylindrical body such that said disc monopole antenna of each of said at least one antenna members is covered by said filling substance at said terminal region on said contact plane-side of said shielding tube facing a face side of said coupling element or said counter-coupling element;

wherein said filling substance is substantially transparent to the GHz frequency range used in the data transmission.

8. The automatic central buffer coupling of claim 1 wherein:

each of said at least one antenna members is configured such that the total attenuation occurring during data transmission does not exceed 77 dB.

9. The automatic central buffer coupling of claim 1 wherein:

said coupling element and said counter-coupling element are each configured such that there is a complete outward encapsulation of said coupling element and said counter-coupling element when said first coupling head and said second coupling head are in the coupled state.

10. The automatic central buffer coupling of claim 1 wherein:

each of said at least one antenna members is hermetically sealed.

11. The automatic central buffer coupling of claim 1 wherein said signal transmission device further comprises:

a first electronic unit assigned to said coupling element coupled said at least one antenna member of said coupling element;

a second electronic unit assigned to said counter-coupling element coupled to said at least one antenna member of said counter-coupling element; and wherein said electronic units are configured to control the signal transmission.

12. The automatic central buffer coupling of claim 11 wherein each of said first electronic unit and said second electronic unit comprises:

an RF unit;

a modulator/demodulator unit;

a baseband processor; and a medium access control or application processor.

13. The automatic central buffer coupling of claim 11 further comprising:

a first coaxial cable coupling said at least one antenna member of said coupling element to said first electronic unit; and a second coaxial cable coupling said at least one antenna member of said counter-coupling element to said second electronic unit.

14. The automatic central buffer coupling of claim 13 wherein each of said first coaxial cable and said second coaxial cable comprises:

an RG-213 coaxial cable having an N-type plug and socket.

15. The automatic central buffer coupling of claim 11 wherein at least one of said first electronic unit and said second electronic unit further comprises:

an additional data interface.

16. The automatic central buffer coupling of claim 15 wherein said additional data interface comprises:

a central standardized serial bus interface for connecting additional hardware.

17. The automatic central buffer coupling of claim 11 wherein:

said coupling element further comprises at least one cable connection area and a first adapter piece;

said counter-coupling element further comprises at least one cable connection area and a second adapter piece;

said automatic central buffer coupling further comprises a first and second coaxial feeder line such that said at least one antenna member of said coupling element is coupled to said at least one cable connection area of said coupling element by said first adapter piece and said first electronic unit is coupled to said at least one cable connection area of said coupling element by said first coaxial feeder line; and said at least one antenna member of said counter-coupling element is coupled to said at least one cable connection area of said counter-coupling element by said second adapter piece and said second electronic unit is coupled to said at least one cable connection area of said counter-coupling element by said second coaxial feeder line.

18. The automatic central buffer coupling of claim 1 wherein:

said coupling element further comprises at least one cable connection area;

said counter-coupling element further comprises at least one cable connection area;

said first coupling head further comprising a first casing, said first casing configured in said first contact plate and accommodating said at least one cable connection area of said coupling element and said at least one antenna member of said coupling element; and said second coupling head further comprising a second casing, said second casing configured in said second contact plate and accommodating said at least one cable connection area of said counter-coupling element and said at least one antenna member of said counter-coupling element.

19. The automatic central buffer coupling of claim 1 wherein:

said signal transmission device comprises a WLAN signal transmission device.

* * * * *